US005729807A

United States Patent [19]

Parker

[11] Patent Number: 5,729,807

[45] Date of Patent: Mar. 17, 1998

[54] OPTICALLY SWITCHED COMMUTATOR SCHEME FOR HYBRID SCAVENGELESS SEGMENTED ELECTRODED DONOR ROLLS

[75] Inventor: Delmer G. Parker, Rochester, N.Y.

[73] Assignee: Xerox Corporation, Stamford, Conn.

[21] Appl. No.: 785,674

[22] Filed: Jan. 21, 1997

[51] Int. Cl.[6] ..... G03G 15/06

[52] U.S. Cl. ..... 399/285; 310/232; 310/237; 347/55; 399/266; 399/291

[58] Field of Search ..... 399/291, 285, 399/266, 279, 90; 310/232, 233, 234, 237; 347/55

[56] References Cited

U.S. PATENT DOCUMENTS

| | | | |
|---|---|---|---|
| 3,996,892 | 12/1976 | Parker et al. | 399/270 |
| 4,568,955 | 2/1986 | Hosoya et al. | 347/55 |
| 4,868,600 | 9/1989 | Hays et al. | 399/266 |
| 5,010,367 | 4/1991 | Hays | 399/266 |
| 5,031,570 | 7/1991 | Hays et al. | 399/266 |
| 5,172,170 | 12/1992 | Hays et al. | 399/266 |
| 5,360,940 | 11/1994 | Hays | 399/266 |
| 5,394,225 | 2/1995 | Parker | 399/291 |
| 5,539,505 | 7/1996 | Parker | 399/285 |
| 5,592,271 | 1/1997 | Parker et al. | 399/285 |
| 5,600,418 | 2/1997 | Hart et al. | 399/285 |

*Primary Examiner*—Arthur T. Grimley
*Assistant Examiner*—Sophia S. Chen

[57] ABSTRACT

A non-interactive or scavengeless development system for use in color imaging. To control the developability of lines and the degree of interaction between the toner and receiver, an AC voltage is applied between a donor roll and two sets of interdigitated electrodes embedded in the surface of the donor roll to enable efficient detachment of toner from the donor to form a toner cloud. An optical switching arrangement effects an electrical connection between a slip ring and one set of interdigitated electrodes. The optical switch uses photoconductor elements, each having a geometry that results in an optical switching device having a larger capacitance and therefore capable of effecting switching at lower current densities.

8 Claims, 5 Drawing Sheets

OPTICALLY SWITCHED COMMUTATOR SCHEME FOR HYBRID SCAVENGELESS SEGMENTED ELECTRODED DONOR ROLLS

BACKGROUND OF THE INVENTION

This invention relates generally to the rendering of latent electrostatic images visible. More particularly, the invention relates to non-interactive or scavengeless development systems and a method and apparatus for commutating power to electrodes of a toner donor roll utilized for scavengeless development.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves latent charge patterns on the imaging surface corresponding to the areas not exposed by radiation.

This charge pattern is made visible by developing it with toner. The toner is generally a colored powder which adheres to the charge pattern by electrostatic attraction. The developed image is then fixed to the imaging surface or is transferred to a receiving substrate such as plain paper to which it is fixed by suitable fusing techniques.

The present invention is especially suited for use in any imaging apparatus requiring scavengeless toner development. Thus, the present invention is useful in imaging processes such as Image On Image (IOI) and highlight color imaging. In scavengeless development, images are formed in a 250 micron development gap intermediate a charge retentive surface and the development system. An AC bias of several hundred volts is applied to one or more small diameter wire electrodes embedded in toner donor roll positioned adjacent a charge retentive surface or photoreceptor in the development zone. The AC bias applied to the development system at a frequency in the kilohertz range acts upon the charged toner to induce a mechanical agitation which is sufficient to overcome adhesive forces that hold toner to the donor roll. Once freed, the toner is readily available to develop the electrostatic latent image on the photoreceptor without disturbing already developed images on thereon.

In earlier renderings of this type of development system, the electrodes consisted of taut wires supported intermediate a photoreceptor and a toner donor roll. See for example U.S. Pat. No. 5,010,367 granted to Dan A. Hays on Apr. 23, 1991. Unfortunately, it has proven difficult to devise a mechanical design for the fragile taut wire array that is both robust, and free of development artifacts. For example, the wires tend to entrap toner agglomerates and spurious paper fibers which can cause streaks in the developed image.

The problems attendant taut wires may be obviated by using an array of small diameter wires or electrodes embedded in the surface of the donor roll. In this approach, the AC bias is applied to the embedded electrodes in the development zone through commutating brushes at the ends of the donor roll. Such a construction is described in U.S. Pat. No. 3,996,892 granted to Parker et al on Dec. 14, 1976. The '892 patent discloses a spatially programmable electroded donor roll wherein an DC voltage is applied to the wire electrodes in the development nip or zone, pre-nip and post-nip zones through commutating brushes at the ends of the donor roll.

Such an arrangement allows the bias profile around the circumference of a two component magnetic brush development roll to be tailored in a way that promotes good development. Thus, a pre-nip voltage of 100 volts, a nip voltage of 250 to 300 volts and a post-nip voltage of 1000 volts are provided. The electrodes on the donor roll were constructed by first plating a thin layer of copper on the outer surface a phenolic roll, and then by etching 0.01" wide electrode strips, on 0.02 centers, axially along the length of the roll. Next, the roll was overcoated with a semiconductive rubber sheath, except for a short length at the ends where the bias was applied to the electrodes through commutating bushes. The voltage profile around the circumference of the roll was determined by the voltage drop due to current flow through the semiconductive sheath from one commutator to another. Such a construction is known to have had problems with wear and pitting of the thin electrodes where they made contact with the commutating brushes. Nickel plating the electrodes helped alleviate the wear problem somewhat, but the electrode damage problem was never completely solved.

The '892 patent, in a second embodiment, discloses the use of a ring-like resistive member mounted for rotation with a donor roll. A plurality of stationarily mounted electrical contacts ride on the ring-like member which, in turn, is seated on the coating free portions of conductors and mounted for rotation with a sleeve upon which the conductors are carried.

Following is a discussion of additional prior art, incorporated herein by reference, which may bear on the patentability of the present invention. In addition to possibly having some relevance to the question of patentability, these references, together with the detailed description to follow, are intended to provide a better understanding and appreciation of the present invention.

U.S. patent application Ser. No. 08/585,070 filed on Jan. 11, 1996, now U.S. Pat. No. 5,592,271, in the name of Parker et al discloses a donor roll for transporting marking particles to an electrostatic latent image recorded on a surface. The donor roll is adaptable for use with an electric field to assist in transporting the marking particles. The donor roll includes a rotatably mounted body. A portion of the body is electrically conductive. The donor roll also includes a dielectric layer mounted on a portion of the electrically conductive portion of the body. The donor roll also includes a first electrode member mounted on the body, adjacent the dielectric layer, and spaced from the electrically conductive portion of the body so that when the electric field is applied to the first electrode member a portion of the field will be transferred to the dielectric layer.

U.S. patent application Ser. No. 08/721,303, now U.S. Pat. No. 5,701,564, filed in the name of Delmer G. Parker on Sep. 26, 1996 discloses an electroded donor roll development unit including an electroded donor roll assembly for mounting partially within a mixing chamber of a housing of the development unit for forming a development nip with an image bearing member, and for moving charged toner particles from the mixing chamber to the development nip. The electroded donor roll assembly includes a donor roll having a dielectric layer, and axially extending electrodes formed in the surface of the dielectric layer. The donor roll assembly also includes a bias voltage source for biasing the electrodes and a tri-contact commutator or assembly mounted on the donor roll and connected to the bias voltage source for commutating a bias voltage to the electrodes while significantly reducing and eliminating risk of sporadic electrical arcing during bias commutation. The tri-contact commutator assembly includes a disc forming a circular flange at one end of the donor roll, a series of commutator contact pads connected to the electrodes on the donor roll and having relatively large fanned out spacings between adjacent contact pads. Importantly, the tri-contact commutator assembly includes a plurality of commutating members, connected to the bias voltage source for commutating a bias voltage to the commutator contact pads. The plurality of commutating members include first and second high resistivity members that are spaced from each other circumferentially relative to the circular flange, and a low resistivity, third member spaced from the high resistivity first and second members in a radial direction relative to the circular flange, so as to enable effective commutation of the bias voltage without significant risk of sporadic electrical arcing.

U.S. Pat. No. 4,568,955 granted to Hosoya also discloses a development or donor roll having electrode structures incorporated therein. Copper electrode structures are deposited on the insulated surface of a donor roll. In one rotational position of the Hosoya et al donor roll, a DC voltage is supplied to alternate ones of the copper electrodes while an AC voltage is supplied to the electrodes intermediate the electrodes having the DC voltage applied thereto. In another rotational position of this donor roll the AC and DC voltages are applied to the opposite electrodes. In other words, each electrode when positioned in the development nip first has one kind of voltage applied and then the other. The AC voltage establishes an alternating electric field for liberating toner particles on the surface of the donor roll. According to the Hosoya et al description, when the AC voltage is greater than the DC voltage the toner particles move from one electrode to an adjacent electrode and when the AC voltage is less than the DC voltage the toner particles move in the opposite direction between two adjacent electrodes.

U.S. Pat. No. 5,031,570 granted to Hays et al on Jul. 16, 1991 and assigned to the same assignee as the instant application discloses a scavengeless development system for use in highlight color imaging. AC biased electrodes positioned in close proximity to a magnetic brush structure carrying a two-component developer cause a controlled cloud of toner to be generated which non-interactively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

U.S. Pat. No. 4,868,600 granted to Hays et al on Sep. 19, 1989 discloses a scavengeless development system in which toner detachment from a donor and the concomitant generation of a controlled powder cloud is obtained by AC electric fields supplied by self-spaced electrode structures positioned within a development nip. The electrode structure is placed in close proximity to the toned donor within the gap or nip between the toned donor and image receiver, self-spacing being effected via the toner on the donor. Such spacing enables the creation of relatively large electrostatic fields without risk of air breakdown.

U.S. Pat. No. 5,010,367 granted to Dan A. Hays on Apr. 23, 1991 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image.

U.S. Pat. No. 5,504,563 granted on Apr. 2, 1996 to Dan A. Hays and assigned to the same assignee as the instant application discloses a scavengeless or non-interactive development system for use in image formation such as highlight color imaging. A toned donor roll structure having two sets of interdigitated electrodes physically supported by an insulative support structure is provided. Both sets of electrodes have a DC bias applied thereto while the other set has an AC bias applied thereto. The AC and DC biases are such as to preclude background development without creating fringe DC fields between adjacent electrodes.

U.S. Pat. No. 5,172,170 granted to Hays et al on Dec. 12, 1992 relates to an apparatus in which a donor roll advances toner to an electrostatic latent image recorded on a photoconductive member. A plurality of electrical conductors are located in grooves in the donor roll. The electrical conductors are spaced from one another and adapted to be electrically biased in the development zone to detach toner from the donor roll so as to form a toner cloud in the development zone. In the development zone, toner is attracted from the toner cloud to the latent image. In this way, the latent image is developed with toner.

U.S. Pat. No. 5,539,505 granted to Delmer G. Parker on Jul. 23, 1996 discloses a non-interactive or scavengeless development system for use in color imaging. A donor roll structure is provided with two sets of interdigitated electrodes which are embedded in the surface of the donor roll. To minimize wear and tear on the electrodes of one set of the interdigitated wire electrodes which are selectively actuated in a development zone, power is commutated thereto via a member that makes rolling contact with the electrodes only in the development zone. In two embodiments of the invention, the contact is made with the electrodes at the outer surface of the donor roll while in another embodiment contact is made on the interior surface of the donor roll structure.

U.S. Pat. No. 5,360,940 granted to Dan Hays on Nov. 1, 1994 a two-component development unit for an electrophotographic printer includes a rotatable donor roll having a plurality of longitudinal electrodes along its circumference. A magnetic structure within the donor roll permits two-component developer to be advanced to a development zone. Adjacent electrodes on the donor roll are AC biased in opposite phases so as create a powder cloud of toner from the developer in the development zone. The magnetic structure is arranged to provide pole effects substantially immediately downstream and upstream of the development zone in the direction of motion of the donor roll.

Optical switching as disclosed in U.S. Pat. No. 5,394,225 granted to Delmer G. Prker on Feb. 28, 1995 provides means to commutate an AC bias applied to Segmented Electroded Donor (SED) rolls. The geometry of the optical switching array in the '225 patent is such that it requires a high current density in the photosensitive switching element. Commutating the 3 KHz, 1300 volt, bias needed for the SED roll embedded electrodes, has proven to be a formidable task. The brushes currently used to commutate the high voltage bias are prone to arcing that can cause permanent damage to the delicate, one micron thick by 100 micron wide metal electrodes.

Approximately 2 cm of the 100 micron wide electrodes are overcoated with a photoconductor at the ends of the donor roll. These electrodes are covered with a layer of transparent conductive material that is electrically connected to the power supply through a slip ring assembly at one end of the roll. The bias is applied to the electrodes by illuminating the photoconductive element with a collimated light beam through the transparent overcoating. Because of the small photoconductor area ($2\times10$–$2$ $cm^2$), the photoconductor current density required to charge the interelectrode capacity (~20 pF) is uncomfortably high.

Interdigitated, ~4 mil wide longitudinal electrodes, spaced at 6 mil intervals around the periphery of the SED donor roll require a bias of 1300 volts at 3 Khz. The capacity of one pair of electrodes is ~20 pF which corresponds to a load impedance ($Xc=1/\omega C$) of $2.6\times10^6$ Ω. To charge this capacity to 1300 volts requires a charge ($Q=CV$) of $2.8\times10^{-8}$ coulombs. The charge density (σ) of a typical, 20μ equivalent thick photoreceptor, charged to 1.3 KV is $-4.4\times10^{-8}$ coulomb/$cm^2$. Thus, the photoconductor area required for each for a SED roll electrode is on the order of 0.6 $cm^2$.

BRIEF SUMMARY OF THE INVENTION

According to the present invention, the high current density in a photosensitive switching element is reduced by employing geometry in which the light activated elements are arranged in pie shaped sectors on one, or both sides of a disc that is mounted at the end of, and coaxially with, the donor roll. The commutator geometry allows the area of the light sensitive switching element to be enlarged compared to that of the '225 patent to a point where the photoconductor operates in a more acceptable current density realm. This geometry also promotes modular construction, and requires less axial space.

DETAILED DESCRIPTION OF THE PREFERRED EMBODIMENT OF THE INVENTION

Figure 5:
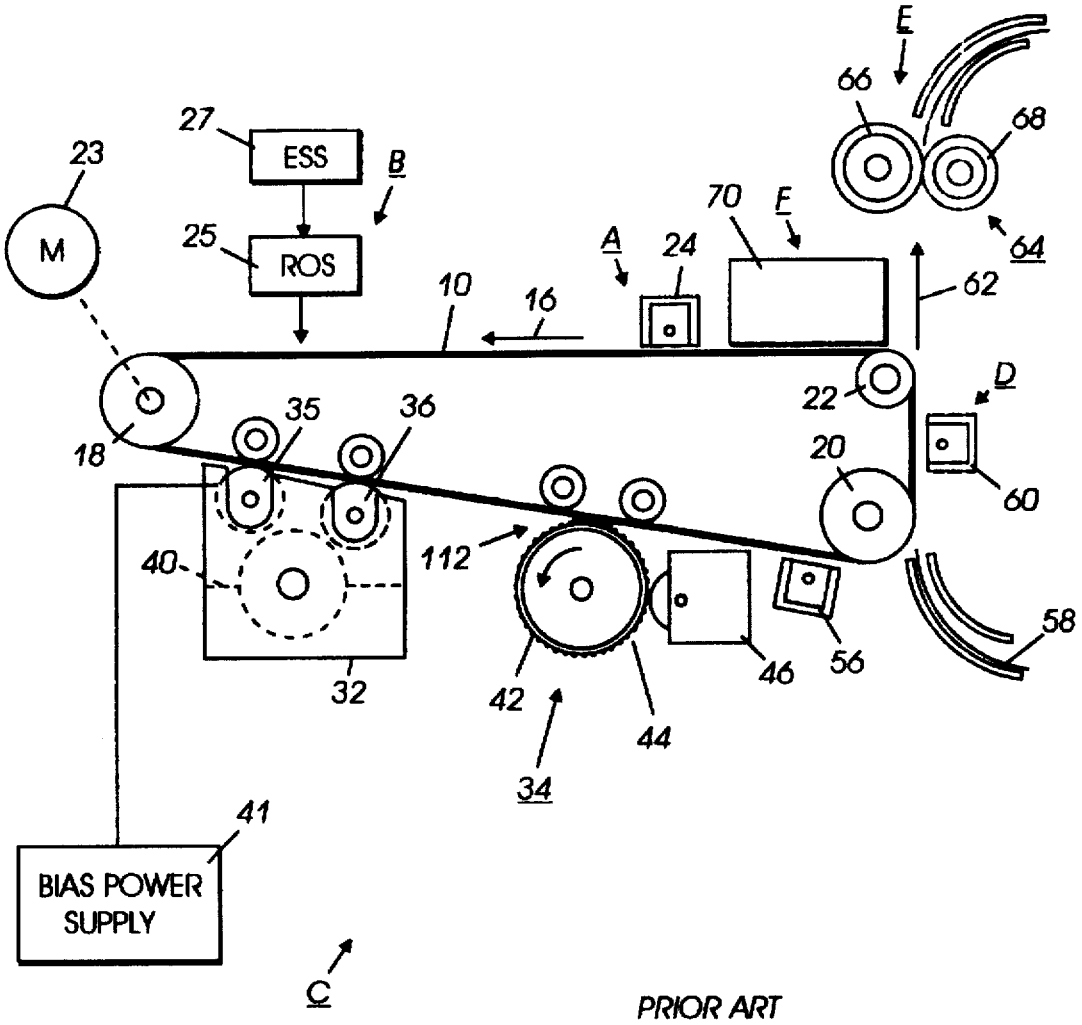
PRIOR ART FIG.5
FIG. 5 is schematic illustration of a printing apparatus incorporating the features of the invention.

As shown in FIG. 5, a highlight color printing machine of the prior art in which the invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 5, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_o$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 27 provides for control of the ROS as well as other sub-assemblies of the machine.

The photoreceptor, which is initially charged to a voltage $V_o$, undergoes dark decay to a level Vddp equal to about −900 volts. When exposed at the exposure station B it is discharged to $V_c$ equal to about −100 volts which is near zero or ground potential in the highlight (i.e. color other than black) color parts of the image. The photoreceptor is also discharged to $V_w$ equal to approximately −500 volts imagewise in the background (white) areas.

At development station C, a development system, advances developer materials into contact with the electrostatic latent images. The development system comprises first and second developer apparatuses 32 and 34. The developer apparatus 32 comprises a housing containing a pair of magnetic brush rollers 35 and 36. The rollers advance developer material 40 into contact with the latent images on the charge retentive surface and develops regions which are at the voltage level $V_c$. The developer material 40 by way of example contains pigmented toner and magnetic carrier beads. Appropriate electrical biasing of the developer housing is accomplished via power supply 41 electrically connected to developer apparatus 32. A DC bias of approximately −400 volts is applied to the development structure 32 via the power supply 41. With the foregoing bias voltage applied and the color toner suitably charged, Discharged Area Development (DAD) with colored toner is effected.

The second developer apparatus 34 comprises a SED donor structure in the form of a roller 42. The donor structure 42 conveys developer 44, which in this case is a single component developer comprising black toner deposited thereon via a combination metering and charging device 46. The toner metering and charging can also be provided by a two component developer system such as a magnetic brush development structure. The donor structure can be rotated in either the 'with' or 'against' direction vis-a-vis the direction of motion of the charge retentive surface. The donor roller 42 is preferably coated with TEFLON-S (trademark of E. I. DuPont De Nemours for tetrafluorethylene fluorocarbon polymer that is loaded with carbon black) or anodized aluminum. The developer apparatus 34 is utilized for developing Charged Area Development (CAD) portions of the latent electrostatic image.

A sheet of support material 58 (FIG. 5) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. The feed roll rotates so as to advance the uppermost sheet from a stack into a chute which directs the advancing sheet of support material into contact with photoconductive surface of belt 10 in a timed sequence so that the toner powder image developed thereon contacts the advancing sheet of support material at transfer station D.

Because the DAD and CAD composite images developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 68 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 70 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 1:
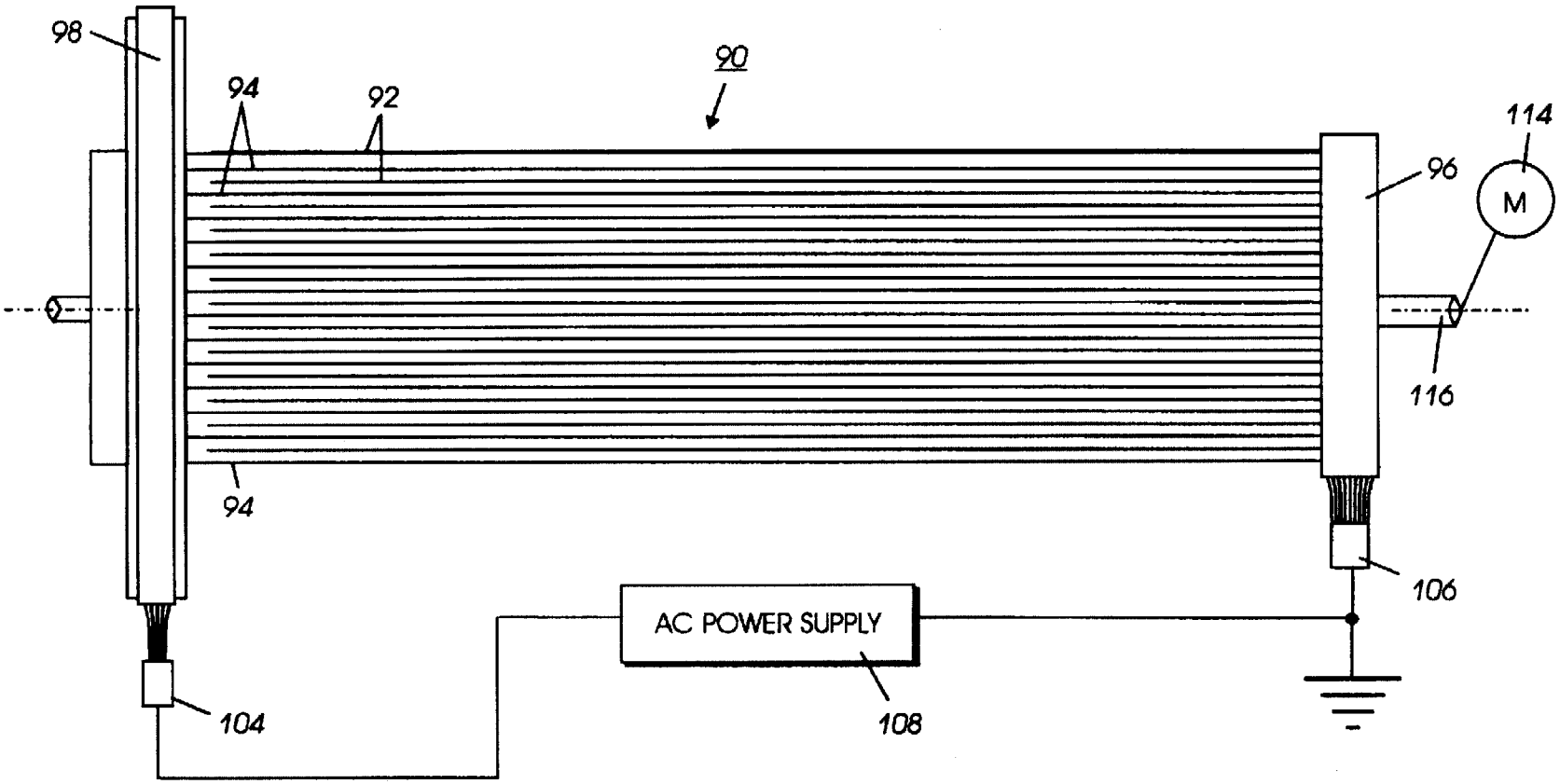
FIG. 1 is a schematic plan view of a development donor roll structure according to the present invention.

A development donor roll structure 90 directed to the features of this invention is illustrated in FIG. 1. As shown therein, the donor structure 90 comprises two sets of interdigitated electrodes 92 and 94, each set comprising about 150 electrodes for a total of about 300. The two sets of electrodes are embedded in the surface of the donor roll structure 90. The ends of the electrodes in the set of electrodes 92 contact a slip ring 96. The electrodes of the other set of electrodes 94 are associated with an opto-electrical switch arrangement to be discussed hereinafter.

An AC bias is applied to the electrodes of the sets of electrodes 92 and 94 through slip rings 96 and 98 via commutating brushes 104 and 106. In operation, the individual electrodes of the set of electrodes 92 are always connected to the AC power supply 108 while the individual electrodes of the set 94 have their electrical bias voltage selectively applied thereto only as they pass through a development zone 112 (FIG. 5). A conventional motor 114 and associated drive coupling (not shown) operatively connected to a donor roll shaft 116 serves to impart rotary motion to the donor roll structure to effect movement of its surface through the development zone 112 (FIG. 5).

Figure 2:
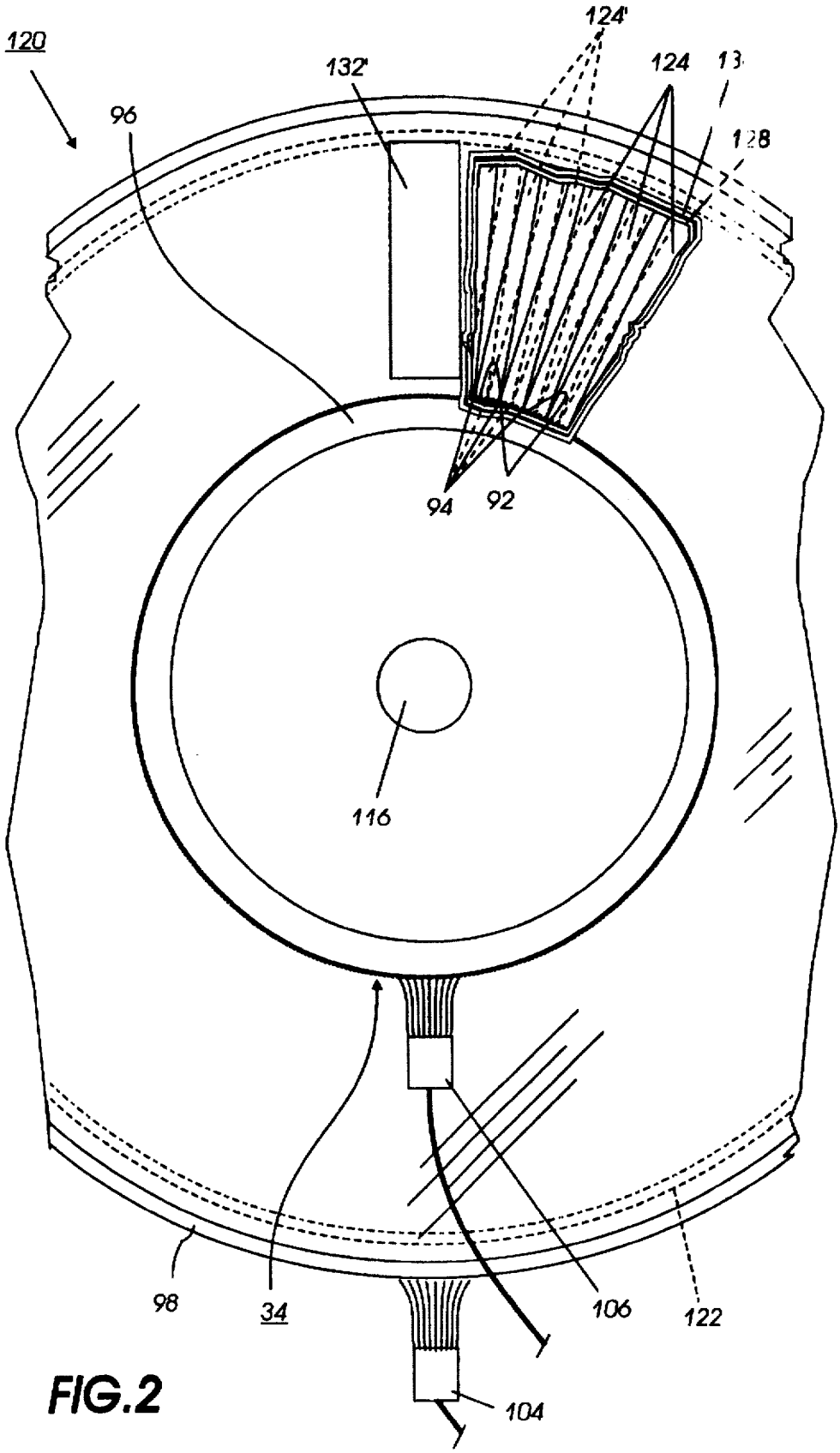
FIG. 2 is an enlarged schematic view of the development roll of FIG. 1 and an opto-electrical switch arrangement according to one form of the invention of Figure, as viewed from the right in FIG. 3.

An opto-electrical switch structure 120, as illustrated in FIG. 2, comprises a printed circuit board fabricated in the shape of a disk 122. A plurality of electrically conductive foil electrodes 124 are formed on the top of the disk 122 and a plurality of electrically conductive foil electrodes 124' are formed on the bottom of the disk 122. The electrodes 124, 124' are pie-shaped and equally spaced about the circumference of the disk. The electrodes 124 and 124' are positioned on the top and bottom surfaces such that the angular positions of the electrodes 124 are staggered relative to the angular position of the electrodes 124'. The degree of staggering or offset of the two sets of electrodes corresponds to the distance between adjacent electrodes on the donor roll. As an example, there may be 75 such electrodes formed on the top of the disk 122 and another 75 on the bottom thereof. The slip ring 98 is mounted on the periphery of the disk 122.

Figure 3:
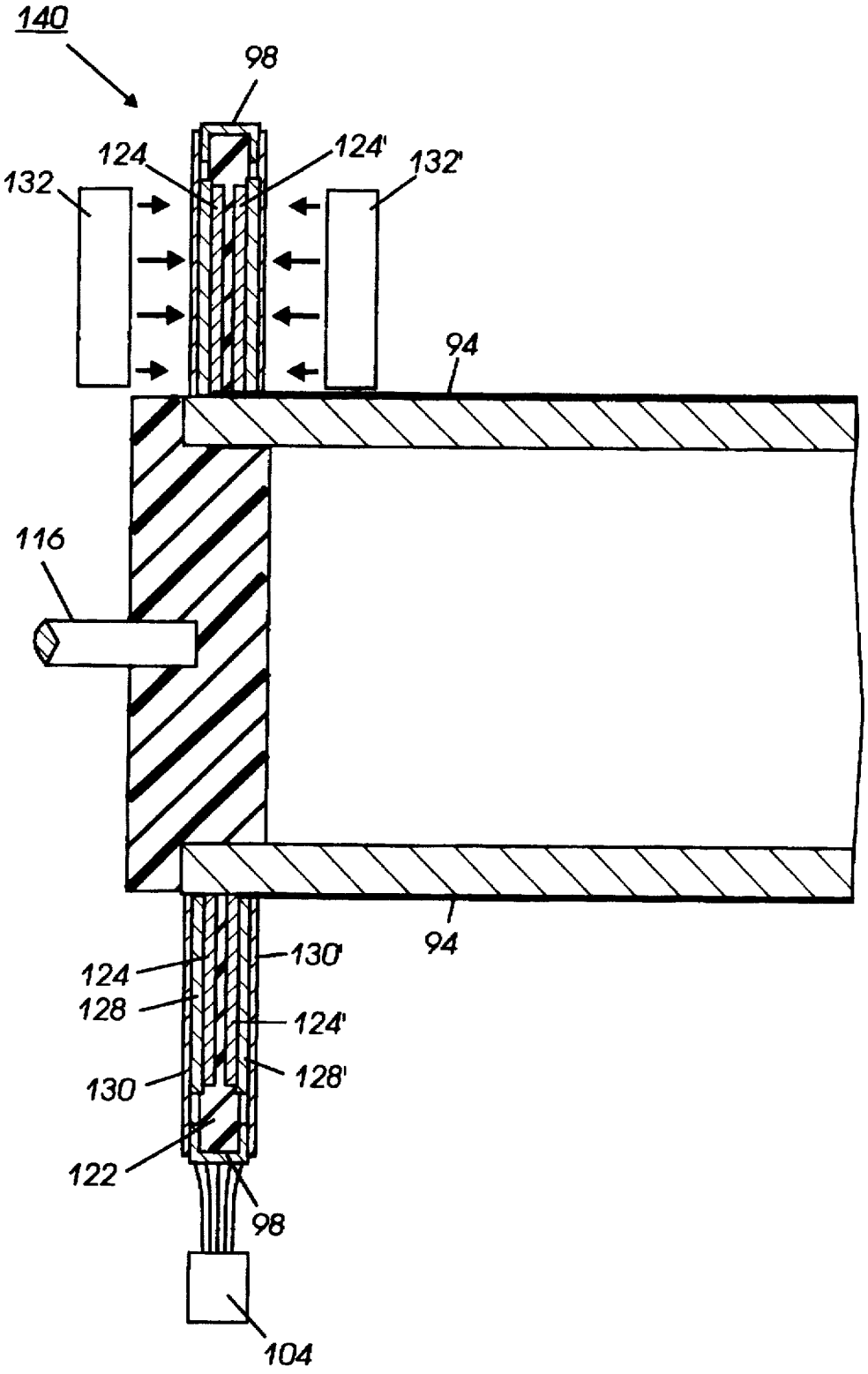
FIG. 3 is an enlarged end elevational view of the switch of FIG. 2.

As seen in FIGS. 2 and 3, annular sheets of photoconductive overcoating 128, 128' are formed over the pie-shaped electrodes 124, 124' but do not contact the slip ring 98. Annular transparent conductive coatings 130, 130' are coated over the photoconductive sheets 128, 128' and make electrical contact with the slip ring 98. The tips of the pie-shaped electrodes 124 contact alternate electrodes of the set of electrodes 94 while the pie-shaped electrodes 124' electrically contact electrodes of the set 94 which are not contacted by the pie-shaped electrodes 124. Illumination from a pair of light sources 132 and 132' which are positioned adjacent the development zone 112 renders the annular photoconductor overcoatings 128, 128' conductive thereby effecting the application of an electrical bias through associated pie-shaped electrodes to only those electrodes of the set 94 which are passing through the development zone 112. The simultaneous application of an electrical bias to adjacent electrodes, one from each set of electrodes 92, 94 only in the development zone serves to restrict release of toner from the donor roll structure to the development zone. According to the present invention, the opto-electric switching arrangement of the '225 patent is replaced by the printed circuit board disk 122 that is mounted on the donor roll adjacent its end, and thus coaxial therewith. The desired area per electrode relationship can be realized by such a configuration. Half the ~300 electrodes around the circumference of the 25 mm diameter SED roll are commutated. The other half are connected to a common return. With half (75) of the light sensitive switching elements being mounted on one side of the disc, and the other half on the other side, the radius of the disc required to produce 75 pie shaped sectors each having an area of 0.6 $cm^2$ can be approximated by:

$$\text{Radius (cm)}=[(R_1)^2+(2A)/(\Phi)]^{1/2}$$

where:

$R_1$=donor roll radius (1.25 cm).

$\Phi$=arc (0.08 radians) subtended by one pie shaped sector and

A=photoconductive area (assumed to be 0.6 $cm^2$)

To obtain an area of 0.6 $cm^2$ requires a 4 cm radius disc. Hence, the area requirement can be satisfied with an ~3 inch diameter, double sided disc. However, in this approximation, the spacing (i.e. 0.002 inch between electrodes 124 and between electrodes 124') required for electrical isolation between sectors has not been taken into account. Consequently, a slightly larger diameter disc will be needed to make up this area. However, some economy of area can be achieved by pairing sectors and commutating two, or perhaps three electrodes in parallel.

Figure 4:
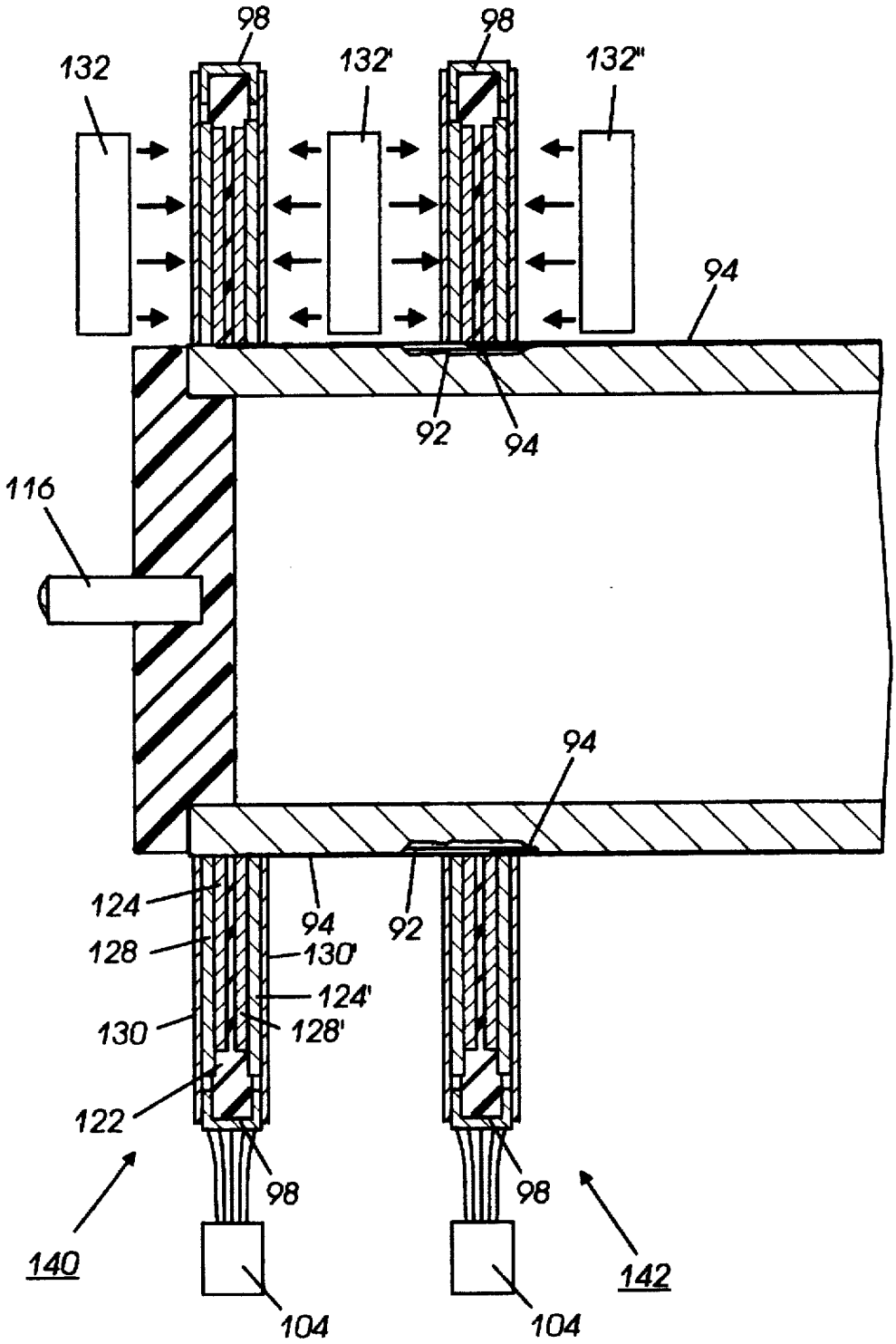
FIG. 4 is a modified form of the opto-electrical switch of FIG. 3.

A lower disc profile (i.e. smaller diameter) can be achieved by connecting two or more discs 140 and 142 in parallel as shown in FIG. 4. To this end, each disk would comprise half the number of electrodes as in the case of embodiment of FIG. 2. Thus, each disk would contain approximately seventy-five electrodes, half on the top of its corresponding disk and half on the bottom. In this embodiment, an additional light source 132" is employed.

Capacitive coupling through the optical switching element will cause a portion of the AC bias to appear across the electrodes even when the switching element is not actuated by light. The magnitude of this voltage is inversely proportional to the capacitance of the optical switching element and can be quite sizable. For instance, the capacitance of the 0.6 $cm^2$, 20 micron equivalent thick photoconductor element described above is ~26 pF compared to the donor roll electrode capacitance of ~20 pF. Hence, the displacement current will produce a bias of ~740 volts across the electrodes at all times. The capacitive feed-through voltage can be adjusted to produce the desired values by increasing the thickness of the photoconductor or by using a smaller area and operating at a higher current density.

The capacity between the electrodes on either side of the double sided commutating disc can also produce feed-through to adjacent electrodes. However, if the disc is made of a circuit board more than two mm thick, voltage feed-though it will contribute less than 130 volts.

The disc commutator geometry disclosed herein affords a way to achieve acceptable photo current densities with a shorter donor roll.

What is claimed:

1. Structure for developing latent electrostatic images on a charge retentive surface with toner particles, said structure comprising:

two sets of interdigitated electrodes carried by a donor roll member used for depositing toner particles on said latent electrostatic images;

a source of electrical power;

means for effecting movement of said structure in an endless path such that a surface thereof passes through a development zone intermediate said charge retentive surface and said donor member;

means for electrically connecting said source of power simultaneously to all electrodes in one of said two sets of interdigitated electrodes;

a switch arrangement having a plurality of individual conductive elements, one conductive element for each electrode of another of said two sets of interdigitated electrodes, each of said conductive elements contacting one electrode of said other set of electrodes, said individual conductive elements being spatially supported on a disk carried by said donor member;

a photoconductive member contactinfi all of said conductive elements, said photoconductive member havinq an annular confiquration that covers all of said individual conductive elements; and illumination means for activating said photoconductive member in a limited area for applying a bias voltage to a corresponding number of electrodes of said another set of said two sets of interdigitated electrodes set which cooperate with adjacent electrodes of said one of said two sets of interdigitated electrodes for enabling liberation of toner from the surface of said donor member only said limited area corresponding to a development zone between said donor member and said charge retentive surface.

2. Structure according to claim 1 wherein said conductive elements have a pie-shaped configuration.

3. Structure according to claim 2 wherein said pie-shaped conductive elements are supported on the top and bottom of said disk.

4. Structure according to claim 3 wherein said pie-shaped conductive elements are supported on said top and bottom of said disk such that pie-shaped conductive elements on the top are staggered relative to the ones supported on the bottom of the disk.

5. Structure according to claim 4 wherein said conductive elements are supported on a plurality of disks carried on by said donor roll.

6. Structure according to claim 4 wherein said pie-shaped conductive elements has an area approximately equal to 0.6 $cm^2$.

7. Structure according to claim 6 wherein the top and bottom of said disk each contain approximately 75 pie-shaped conductive elements.

8. Structure according to claim 7 wherein the top and bottom for each of said disks contains approximately 32 pie-shaped conductive elements.

* * * * *